US010847330B2

(12) United States Patent
Dooley

(10) Patent No.: US 10,847,330 B2
(45) Date of Patent: Nov. 24, 2020

(54) NO/LOW-WEAR BEARING ARRANGEMENT FOR A KNOB SYSTEM

(71) Applicant: Grayhill, Inc., La Grange, IL (US)

(72) Inventor: Kevin Dooley, Chicago, IL (US)

(73) Assignee: Grayhill, Inc., LaGrange, IL (US)

( * ) Notice: Subject to any disclaimer, the term of this patent is extended or adjusted under 35 U.S.C. 154(b) by 53 days.

(21) Appl. No.: 16/154,125

(22) Filed: Oct. 8, 2018

(65) Prior Publication Data

US 2019/0108953 A1 Apr. 11, 2019

Related U.S. Application Data

(60) Provisional application No. 62/568,854, filed on Oct. 6, 2017.

(51) Int. Cl.

| | |
|---|---|
| ***H01H 19/14*** | (2006.01) |
| ***H01H 19/11*** | (2006.01) |
| *H01H 3/02* | (2006.01) |
| *H01H 3/32* | (2006.01) |
| *H01H 25/06* | (2006.01) |

(52) U.S. Cl.

CPC ..... *H01H 19/14* (2013.01); *H01H 19/11* (2013.01); *H01H 25/06* (2013.01); *H01H 2003/0293* (2013.01); *H01H 2003/326* (2013.01); *H01H 2229/064* (2013.01)

(58) Field of Classification Search

CPC ..... H01H 19/14; H01H 19/11; H01H 25/06
USPC ..... 200/11 R
See application file for complete search history.

(56) References Cited

U.S. PATENT DOCUMENTS

| | | | | |
|---|---|---|---|---|
| 5,657,012 | A | 8/1997 | Tait | |
| 5,831,554 | A | 11/1998 | Tromblee | |
| 5,831,596 | A | 11/1998 | Marshall et al. | |
| 5,959,267 | A * | 9/1999 | Kawasaki | H01H 25/06 200/11 R |
| 6,059,660 | A | 5/2000 | Takada et al. | |
| 6,388,655 | B1 | 5/2002 | Leung | |
| 6,580,418 | B1 | 6/2003 | Grome et al. | |
| 6,606,085 | B1 | 8/2003 | Endo et al. | |
| 7,019,732 | B2 | 3/2006 | Furukawa | |
| 7,265,304 | B2 | 9/2007 | Ichiki et al. | |
| 7,429,977 | B2 | 9/2008 | Edmunds | |
| 7,433,760 | B2 | 10/2008 | Alzarez et al. | |
| 7,474,296 | B2 | 1/2009 | Obermeyer et al. | |
| 7,595,712 | B2 | 9/2009 | Nishino et al. | |

(Continued)

*Primary Examiner* — William A Bolton
*Assistant Examiner* — Iman Malakooti
(74) *Attorney, Agent, or Firm* — K&L Gates LLP

(57) ABSTRACT

The present disclosure is directed to knob systems and methods to permit a smooth turning user input device that minimizes unintended horizontal displacement, along the X- or Y-axis, or unintended vertical displacement, along the Z-axis. The disclosed knob system may achieve this goal through the use of a back plate, a knob and a main housing extending through the knob and the back plate, the back plate comprises a plurality of Z-stop bearings, comprising a plurality of Z-stop balls and a plurality of Z-support springs, wherein the Z-stop bearings are in contact with the back plate and are configured to separate the knob from the back plate when the main housing is depressed in a vertical direction and wherein each of the plurality of Z-stop balls are attached to one of the plurality of Z-support springs, the Z-support springs bias the Z-stop ball against the knob.

20 Claims, 7 Drawing Sheets

(56) References Cited

U.S. PATENT DOCUMENTS

| | | | | |
|---|---|---|---|---|
| 8,083,590 | B2 | 12/2011 | Nourry | |
| 8,094,121 | B2 | 1/2012 | Obermeyer et al. | |
| 8,164,405 | B2 | 4/2012 | Hsu et al. | |
| 8,264,458 | B2 | 9/2012 | Cooper et al. | |
| 8,344,834 | B2 | 1/2013 | Niiyama | |
| 8,344,914 | B2 | 1/2013 | Yeh | |
| 8,345,005 | B2 | 1/2013 | Jaouen | |
| 2004/0222965 | A1 | 11/2004 | Riccomini et al. | |
| 2005/0052425 | A1 | 3/2005 | Zadesky et al. | |
| 2005/0195166 | A1 | 9/2005 | Cooper et al. | |
| 2006/0066588 | A1 | 3/2006 | Lyon et al. | |
| 2008/0012837 | A1 | 1/2008 | Marriott et al. | |
| 2008/0100568 | A1 | 5/2008 | Koch et al. | |
| 2008/0309632 | A1 | 5/2008 | Koch et al. | |
| 2008/0227547 | A1* | 9/2008 | Nourry | H01H 25/04 463/38 |
| 2009/0072662 | A1 | 3/2009 | Sadler et al. | |
| 2010/0090813 | A1 | 4/2010 | Je et al. | |
| 2010/0241973 | A1 | 9/2010 | Whiddett | |
| 2011/0095877 | A1 | 4/2011 | Casparian et al. | |
| 2011/0163957 | A1 | 7/2011 | Jaouen | |
| 2011/0164029 | A1 | 7/2011 | King et al. | |
| 2012/0038471 | A1 | 2/2012 | Kim et al. | |
| 2012/0162076 | A1 | 6/2012 | Obermeyer et al. | |
| 2013/0113729 | A1 | 5/2013 | Chiang | |
| 2013/0127825 | A1 | 5/2013 | Joshi | |
| 2014/0024110 | A1 | 1/2014 | Knofe et al. | |
| 2014/0071079 | A1 | 3/2014 | Heubel et al. | |
| 2015/0089452 | A1 | 3/2015 | Dorninger | |
| 2016/0079014 | A1* | 3/2016 | Takano | H01H 19/48 200/11 A |
| 2016/0202721 | A1 | 7/2016 | Bernardy et al. | |

* cited by examiner

NO/LOW-WEAR BEARING ARRANGEMENT FOR A KNOB SYSTEM

PRIORITY CLAIM

This application is a non-provisional of, and claims the benefit of and priority to U.S. Provisional Patent Application No. 62/568,854, filed Oct. 6, 2017, incorporated by reference herein in its entirety.

BACKGROUND

The present application generally relates to knob systems; more specifically the present application relates to systems and methods for implementing knob movement with reduced wear on the internal arrangements and devices related thereto.

A typical knob system is designed to slide or rotate in the X-, Y-, and Z-directions. To facilitate the movement of the knob system, bearings may be used between contacting parts to provide a reduced friction environment between the parts that would have otherwise contacted. A bearing is implemented in a knob system to allow for smooth movement in the directions where knob movement is guided by the bearing. Bearings also allow for limited wear of moving parts to increase the life of moving components. However, bearings are expensive relative to the cost of a knob system, and often are only available in pre-defined size ranges. Sometimes metal bearings will be substituted with plastic bearings or bearing systems to reduce cost. Plastic parts, however, can have varying useable lives and will typically wear faster than a metal bearing. Further, relatively looser tolerances associated with plastic parts and increased wear can result in unintended movement in the knob system. This can result in either high-rework in the manufacturing process, reduced product lifespan, or reduced customer satisfaction with the product.

Therefore, a need exists for a low cost, reliable, readily replicable, low-drag alternative to currently available bearing systems.

SUMMARY OF THE INVENTION

The present disclosure allows for a smooth turning device without extra unintended horizontal displacement, along the X- or Y-axis, or vertical displacement, along the Z-axis. The present disclosure includes a bearing system that provides the device with long rotational life and low friction so detents in the movement of the knob can be felt by the user. If the primary rotation is around the Z-axis, the present disclosure restricts rotation about the X-axis and Y-axis, and liner movement about the X-, Y-, Z-axis. The effect of loose tolerances associated with plastic parts and increased wear may be unintended movement in the knob system, which may be described by those in the art as wobble. The uses of springs in the present system provides a constant force in the wear surface so the feel stays the same though life of the knob system. This also allows for consistent feel though mass production.

In one embodiment, the disclosed apparatus includes a knob, a main housing and a back plate. The main housing may be concentrically located within the knob. The main housing may extend axially through the knob. The knob may be mounted atop the back plate. The main housing may extend axially through the back plate. The knob may comprise an outer perimeter wall extending circularly around a main housing. The main housing may also comprise a circular central aperture, and may comprise a plurality of ridges spaced around the aperture surface of the knob. The circular aperture may be located in a knob plate, which may extend from the circular aperture to an inner surface of the outer perimeter wall. The knob plate may include a horizontal portion extending outwardly from the circular aperture. The knob plate may also include an inclined portion extending from the horizontal portion to the inner surface of the outer perimeter wall. The inclined portion may have an upper surface and a lower surface. The knob may further include a receiving portion in the lower surface of the inclined portion.

In some embodiments, a plurality of ridges spaced equidistantly around the central aperture surface act as a grease reservoir, the grease for use to lubricate a contact surface between the inner surface of the perimeter wall and the inclined portion of the main housing. The contact surface acts as a seal to restrict the grease from flowing out from the area between the ridges in the main housing. In this manner, the plurality of ridges act as a grease reservoir to slowly release grease over a period of time to provide lubrication to the contact surface, which in turn decreases wear on the contact surface.

The features and advantages described herein are not all-inclusive and, in particular, many additional features and advantages will be apparent to one of ordinary skill in the art in view of the figures and description. Moreover, it should be noted that the language used in the specification has been principally selected for readability and instructional purposes, and not to limit the scope of the inventive subject matter.

DETAILED DESCRIPTION OF EXAMPLE EMBODIMENTS

Figure 1:
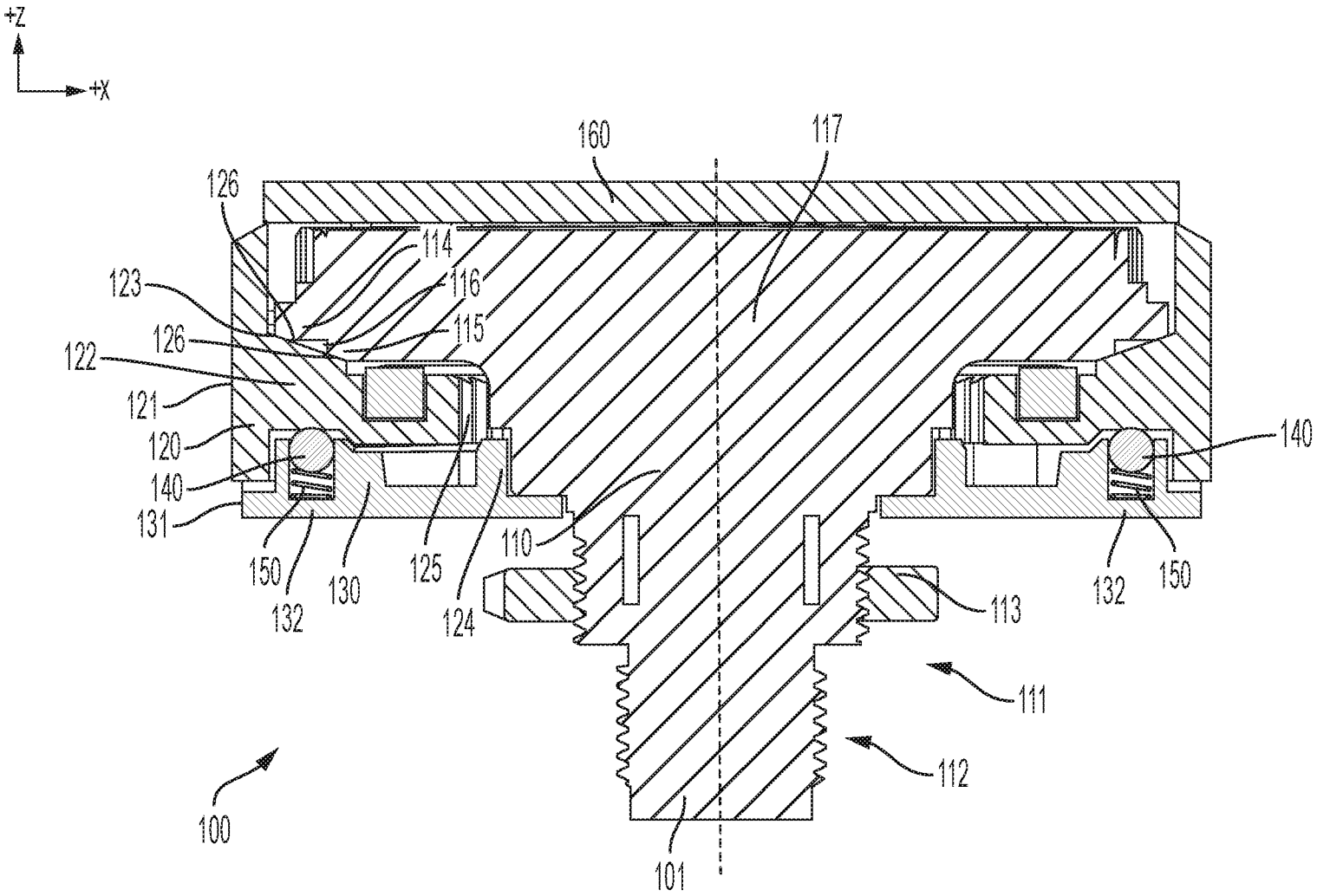
FIG. 1 illustrates a cross sectional view of the knob system in accordance with an embodiment of the present application.

Detailed embodiments of devices and methods are disclosed herein. However, it is to be understood that the disclosed embodiments are merely exemplary of the devices and methods, which may be embodied in various forms. Therefore, specific functional details disclosed herein are not to be interpreted as limiting, but merely as a basis for the claims as a representative example for teaching one skilled in the art to variously employ the present disclosure.

The present application relates to knob systems for electronic devices. Knob systems generally receive user input through user interaction with the knob system, thus allowing the user to communicate with the electronic device the knob system is configured to relay information to. Knob systems can be configured to rotate in either a clockwise or counterclockwise direction, and can optionally be configured to receive an input via a press, which may be a user depression in the Z-direction perpendicular to the X-Y plane in which the knob system may be configured to rotate. A knob system may be further configured to receive a combination of a press and rotation by a user, which may indicate yet another type of user input into the knob system.

Embodiments of the disclosed knob system may further include one or more tactile feedback mechanisms. The tactile response mechanisms receive user input and provide a tactile response to the user to indicate that the user has selected a particular location or selectable area on the user interface. The tactile response mechanisms may be in the form of a mechanical click caused by one or more changes in contact between two moving pieces. The tactile responses mechanisms may be in the form of an electronically generated response such as a sound wave or propagation.

Embodiments of the disclosed knob system may further include a touch screen on or facing in the positive Z-direction of the knob surface. Such a screen allows for customizable graphics on the surface of the knob system. Customizable graphics may be operational instructions to the user, may be informational instructions to the user, may convey information about the use of the button, may give the user feedback about the user's interaction with the knob system, and/or may be customizable to allow for different uses or functionalities of the knob system.

In an embodiment, the knob system may be integrated into and utilized with any number of electronic devices. For example, computers, tablet computers, mobile phones, electronic medical devices (for example, ultrasound machines), and other electronic devices that use touch-screen type interfaces may advantageously incorporate the disclosed knob system. Similarly, the knob system may be integrated into electronic devices that do not have a touch-screen type interface and that instead have a display screen and rely upon other input/output (I/O) devices to receive user inputs.

In an embodiment of a knob system, there may be a knob, a main housing and a back plate. The main housing may be concentrically located within the knob. The main housing may extend axially through the knob. The knob may be mounted atop the back plate. The main housing may extend axially through the back plate. For purposes of this embodiment, the phrase "axially" is used to describe the Z-direction (see FIG. 1). Further, for purposes of this embodiment, concentrically can be taken to understand an alignment of the center point of the knob and main housing, and additionally the back plate, such that the components are centered around a single location or axis. For example, as in FIGS. 4 and 5 all three components may be centered on the same X and Y coordinates, and this centered around a Z axis, as defined in FIG. 1.

The knob may be made of stainless steel, steel, iron, nickel, copper, aluminum or other suitable metal. The knob may also be made of a thermoplastic such as polyethylene, polypropylene, polystyrene, polyvinyl chloride, acrylonitrile butadiene styrene and/or combinations thereof. The knob may also be made of a thermosetting polymer.

The main housing may be made of a molded plastic such as polyethylene, polypropylene, polystyrene, polyvinyl chloride, acrylonitrile butadiene styrene and/or combinations thereof.

The knob or main housing may optionally be made of varying materials. For example, contact surfaces between various moving parts of the knob system may be comprised of a first material, and structural components of the knob system may be comprised of a second material. In such an embodiment, the first material may be selected to decrease wear on the contact surfaces. Further, the second material may be selected to decrease weight of the knob assembly.

The back plate may be made of a molded plastic such as polyethylene, polypropylene, polystyrene, polyvinyl chloride, acrylonitrile butadiene styrene and/or combinations thereof.

The knob may comprise an outer perimeter wall extending circularly around a main housing. The main housing my optionally additionally comprise a central aperture. The central aperture may be circular, substantially circular or may comprise a plurality of ridges spaced equidistantly around the aperture surface of the knob. An exemplary central aperture may comprise six ridges, but may also comprise more or less ridges. The circular aperture may be located in a knob plate. The knob plate may extend from the circular aperture to an inner surface of the outer perimeter wall. The knob plate may include a horizontal portion extending outwardly from the circular aperture. The knob plate may also include an inclined portion extending from the horizontal portion to the inner surface of the outer perimeter wall. The inclined portion may have an upper surface and a lower surface. The upper surface of the inclined portion may be at an upward angle of 20° in relation to the horizontal portion. The upward angle may also be 25°, 30°, 35°, 40°, or 45°. The knob may further include a receiving portion in the lower surface of the inclined portion.

Preferably the upper surface (or wear surface) is at an upward angle of 20° in relation to the horizontal portion. In the case where the upper surface extends circumferentially around the center of the knob system at a constant angle, an upward angle of 20° has been found to provide support in all axes.

In some embodiments, a plurality of ridges spaced equidistantly around the central aperture surface act as a grease reservoir. In such an embodiment, grease is included in the spaces between the plurality ridges. Grease may lubricate a contact surface between the inner surface of the perimeter wall and the inclined portion of the main housing. Lubricating the contact surface between the inner surface of the perimeter wall and the main housing allows for decreased wear, and results in increased life of the knob system. Lubrication of the contact surface further allows for smooth rotational movement of the knob. In still further embodiments, the contact surface acts as a seal to restrict the grease from flowing out from the area between the ridges in the main housing. In this manner, the plurality of ridges act as a grease reservoir to slowly release grease over a period of time to provide lubrication to the contact surface, which in turn decreases wear on the contact surface.

The knob may be configured to rotate around the main housing when the outer perimeter wall is grasped by a user and a rotational force is applied. The knob may be further configured to be depressed against the back plate (e.g., in the axial or z-axis direction in the context of FIG. 1) when a depression force is applied.

The back plate may extend from a central aperture to an outer perimeter edge. The under surface of the back plate may be substantially planar. The upper surface of the back plate may comprise a support channel circumnavigating the central aperture of the back plate. The support channel may be sized to removably contain a plurality of Z-stop balls, Z-support springs, and Z-stops. Removably contain is understood to mean at a first point in time the contents are located within and at a second point in time the contents may be removed.

Embodiments of the disclosed knob system may include four Z-stop balls removably contained with the support channel. Each Z-stop ball may be attached to a Z-support spring or rest atop a Z-support spring. The Z-support spring biases the Z-stop ball against the lower surface of the inclined portion of the knob to provide a consistent and constant force into the lower surface of the inclined portion of the knob. The Z-stop balls may be positioned at periodic locations in the support channel. When there are four Z-stop balls, each ball may be located 90° from the next Z-stop ball. In other embodiments, the disclosed knob system may rely on five Z-stop balls and each ball may be located 72° from the next Z-stop ball. In some embodiments, the disclosed knob system relies on three Z-stop balls, each Z-stop ball located 120° from the next Z-stop ball.

When a depression force is applied to the knob, the knob may move the distance that the Z-support spring is able to compress in the support channel. For example, a depression force may be applied to the knob in the Z-direction. The knob then translates the force to the Z-stop ball. The Z-support ball then translates the force to the Z-support spring associated with the Z-stop ball, compressing the spring against the back plate. The amount of deflection in the Z-direction is determined by the maximum deflection of the spring, the force in the Z-direction, and the spring rate of the spring.

The Z-stop balls allow for manufacturing tolerances while maintaining consistent forces throughout the life of the knob. The Z-support springs allow consistent and constant support. Without the Z-support spring there would have to be play (or a gap) between parts for freedom of motion, so embodiments of the disclosed knob system that include the combination of Z-stop balls and Z-support springs reduce the need for play and ensures anti-wobble knob functionality can be obtained.

The Z-stop balls may ensure the same feel when the knob is depressed and rotated as when the knob is rotated without depressing. The Z-stop balls prevent the knob from grinding against the back plate. If there are more than three Z-stop balls, they may be located at equally spaced intervals throughout the support channel.

The main housing may comprise a top surface, an outer perimeter, an under surface, and a lower protrusion. The top surface may comprise a touchpad or touch screen. The touchpad may be a mutual projected capacitance touchpad. As known to one having ordinary skill in the art, a mutual projected capacitance touchpad has a protective cover located on a bonding layer. Under the bonding layer, a first layer has insulating material containing parallel driving lines, and a second layer has insulating material containing parallel sensing lines which are perpendicular to the driving lines. The first layer may be located above the second layer. A glass substrate is located under the first layer and the second layer, and a LCD display is located under the glass substrate. A capacitor is formed by one of the driving lines intersecting with one of the sensing lines. A voltage is applied to the driving lines, and positioning a finger or a conductive stylus on and/or proximate to the protective cover changes the local electric field to reduce the mutual capacitance at that location. The capacitance change at discrete points on the grid may be measured to determine the touch location by measuring the voltage in the sensing line.

The touchpad may have and/or may be a digital resistive touchpad, an analog resistive touchpad, a resistive single touch touchpad, a resistive multi-touch touchpad, a surface capacitance touchpad, a self-projected capacitance touchpad, a film touch screen, and/or an infrared touchpad. One or more of the sensing elements of the touchpad may be constructed from materials which are opaque and/or transparent, such as a ridged printed circuit board and/or a flexible printed circuit board. The present disclosure is not limited to a specific embodiment of the touchpad.

The touchpad PC board may be located under the touchpad and/or proximate to the touchpad. The touchpad PC board may generate signals in response to a user manipulating the touchpad. The touchpad may detect one or more touches; in an embodiment, the touchpad may detect five touches. The touchpad may detect one or more touches on the touchpad, one or more movements on the touchpad, an amount of time of the one or more movements on the touchpad, a speed of the one or more movements on the touchpad, and/or the like. The signals generated by the touchpad PC board may indicate the one or more touches on the touchpad, the one or more movements on the touchpad, the amount of time of the one or more movements on the touchpad, the speed of the one or more movements on the touchpad, and/or the like.

FIG. 1 illustrates an exemplary embodiment of the knob system 100. In this example embodiment, the knob system 100 comprises a main housing 110, a knob 120, and a back plate 130. The knob 120 is be concentrically located in the main housing 110 and the back plate 130 along the knob system centerline 101. The main housing 110 extends axially through the back plate 130.

In the illustrated embodiment, the main housing 110 comprises a central aperture 111 extending in the negative Z-direction below the back plate 130 along knob system centerline 101. The central aperture 111 comprises a plurality of ridges 112 and 113 around the central aperture 111. In such an embodiment, the ridges 112 and 113 around the central aperture 111 are be divided into a plurality of sets. For example, the embodiment in FIG. 1 shows two sets of ridges 112 and 113 around the central aperture 111.

The back plate 130 extends from the central aperture 111 to an outer portion 131. The surface of the back plate 130 extending in the negative Z-direction is substantially planar. The surface of the back plate 130 may be further configured to be affixed to a knob system mount 610 or other location desired by the user. The back plate 130 further comprises a back plate channel 132. The back plate channel 132 comprises a circular cutout that includes an inner portion 124 and an outer portion 131 with a base area between the inner portion 124 and the outer portion 131. The space between the inner portion 124 and the outer portion 131 defines the back plate channel 132. The back plate channel 132 extends continuously within the back plate 130. The back plate channel 132 is configured to receive a Z-support spring 150. The back plate channel 132 is sized such that the space between the inner portion 124 and outer portion 131 is great enough to contain the Z-support spring 150. The back plate channel 132 may be configured to span the entire circumference of the back plate 130. In an embodiment, the back plate channel 132 is configured to receive a plurality of Z-support springs 150. For example, in some embodiments the back plate channel 132 is configured to support four Z-support springs 150 spaced equidistantly around the circumference of the back plate channel 132. In an embodiment, a plurality of Z-support springs 150 are spaced non-uniformly around the circumference of the back plate channel 132. The back plate channel 132 additionally may not extend continuously. In this embodiment, the back plate channel 132 may comprise a plurality of back plate channel portions, one portion for each Z-support spring 150 contained therein and the space between the back plate channel portions may be full of the same material that is used to make the back plate 130.

In the present embodiment, each Z-support spring 150 is positioned to receive a Z-stop ball 140. In such an embodiment, the back plate channel 132 is likewise configured to receive a Z-stop ball 140. As a result, the Z-support spring 150 will bias the Z-stop ball 140 in the positive Z-direction.

The plurality of Z-stop balls 140 are further configured to extend in the positive Z-direction, as biased by the plurality of Z-support springs 150, to contact the knob plate 122. The knob plate 122 is defined by the outer wall 121, the inclined portion 123, and the inner wall 125. This configuration results in the Z-support spring 150 and the Z-stop ball 140 biasing the knob plate 122 in a positive net Z-direction from the back plate 130. Further, as the back plate channel 132 is configured to receive the Z-stop ball 140, the Z-stop ball 140 and Z-support spring 150 biased in the positive Z-direction offers low resistance in clockwise or counterclockwise rotational motion in the X-Y plane. However, the back plate channel 132 is further configured to limit linear motion of the Z-stop ball 140 in the X-Y plane as the central aperture 111 is configured to extend axially through the back plate 130. As such, any linear X-Y motion of the Z-stop ball 140 is resisted by the back plate 130. The net result of such an embodiment is to limit the input from a user to rotational motion of the knob 120 to the X-Y plane around the knob system centerline 101 and linear motion of the knob 120 to the Z-direction. For a user, this configuration results in a knob 120 the user can rotate and depress.

The knob system 100 in the illustrated embodiment is further configured to comprise an inclined portion 123 configured to further resist linear movement of the knob 120 in the X-Y plane. In such an embodiment, the inclined portion 123 is configured to seat against contact surface 126 of the main housing 110. In one example, the inclined portion 123 may be at an angle of 20° from the horizontal X-Y plane. In an embodiment, the upward angle may be any angle from 0° to 90°, for example, angles of 25°, 30°, 35°, 40°, or 45° from the horizontal X-Y plane. The inclined portion 123 is configured to resist linear movement in the X-Y plane because any linear movement of the knob 120 in the X-Y plane will result in inclined portion 123 contacting the contact surface 126 of the main housing 110, which is linearly fixed in the X-Y plane. Since the inclined portion 123 and contact surface 126 extend circumferentially about the knob system centerline 101, such an embodiment will resist deflection according to any linear vector in the X-Y plane, however, will still allow for the knob 120 to rotate around the knob system centerline 101 and allow the knob 120 to be depressed linearly in the Z-direction.

In the illustrated embodiment, the contact surface 126 will comprise a plurality of ridges. For example, the embodiment shown in FIG. 1 has two ridges between the contact surface 114 and 115. Such a configuration results in a cavity between the ridges 116. However, one with skill in the art will recognize that additional ridges may be present, which will result in additional cavities between the ridges. Here, for simplicity only two ridges between the contact surface 114 and 115 with a single cavity between the ridges 116 are shown. In some embodiments, the cavity between the ridges 116 may be filled with grease or other lubricant, thereby allowing for the grease or other lubricant to lubricate the area where the inclined portion 123 and contact surface 126 comprised of ridges between the contact surface 114 and 115 slide in contact with one another. Such movement is the result of rotational motion applied by the user to the knob 120 in the X-Y plane. In this manner the subsystem of the two ridges between the contact surface 114 and 115, single cavity between the ridges 116 and inclined portion 123 create a grease reservoir, thus allowing grease or other lubricant to lubricate the above described contact areas between the inner surface of the perimeter wall of the knob 120 and the outer perimeter surface of the main housing 110. Lubrication of the contact surface 126 between the inner surface of the perimeter wall and the main housing 110 allows for decreased wear, and results in increased life of the system. Lubrication of the contact areas between the inner surface of the perimeter wall of the knob 120 and the outer perimeter surface of the main housing 110 further allows for smooth rotational movement of the knob 120. In such an embodiment, the contact surface 126 may act as a seal to restrict the grease from flowing out from the area between the ridges between the contact surface 114 and 115. In this manner, the ridges between the contact surface 114 and 115 act as a grease reservoir to slowly release grease or other lubricant over a period of time as a function of at least the viscosity of the lubricant and use of the knob 120 to provide lubrication to the area where the inclined portion 123 and contact surface 126 comprised of ridges between the contact surface 114 and 115 slide in contact with one another. This, in turn, decreases wear on the sliding contact surface 126.

In the illustrated embodiment of FIG. 1, the main housing 110 is configured to receive a display 160. In such an embodiment, the main housing 110 comprises a central portion 117 configured to receive a display 160. The central portion 117 configured to receive a display 160 may be configured such that the display 160 rotates with the rotational movement of the knob 120, or is in a fixed orientation on the main housing 110. In either configuration, the display 160 will visually communicate relevant information to the user. For example, the display 160 may communicate the rotational position of knob 120, which may correlate to a setting controlled by a user input via the knob system 100. In either configuration, the display 160 is configured to receive inputs from the user by manipulating the knob system 100 or from an external computer readable medium. In the case where the display 160 receives input from an external computer readable medium, the display 160 may communicate via a wired connection or a wireless connection, such as a Bluetooth®, USB, Ethernet, 802.11 or other permissible LAN connection. The external computer readable medium may also receive inputs from the display 160 or the knob system 100. In an embodiment, the display 160 and knob system 100 may communicate with separate computer readable mediums. In an embodiment, the display 160 may comprise a computer readable medium.

In some embodiments, the display 160 further includes a touchpad. In such an embodiment, the touchpad includes sensing elements to receive inputs from the user. Such an embodiment may enable a user to further communicate with the knob system 100 by adding swiping, touching, tapping, or sliding control capability to the X-Y rotational and linear Z-direction movement of the knob system 100 discussed above.

Figure 2:
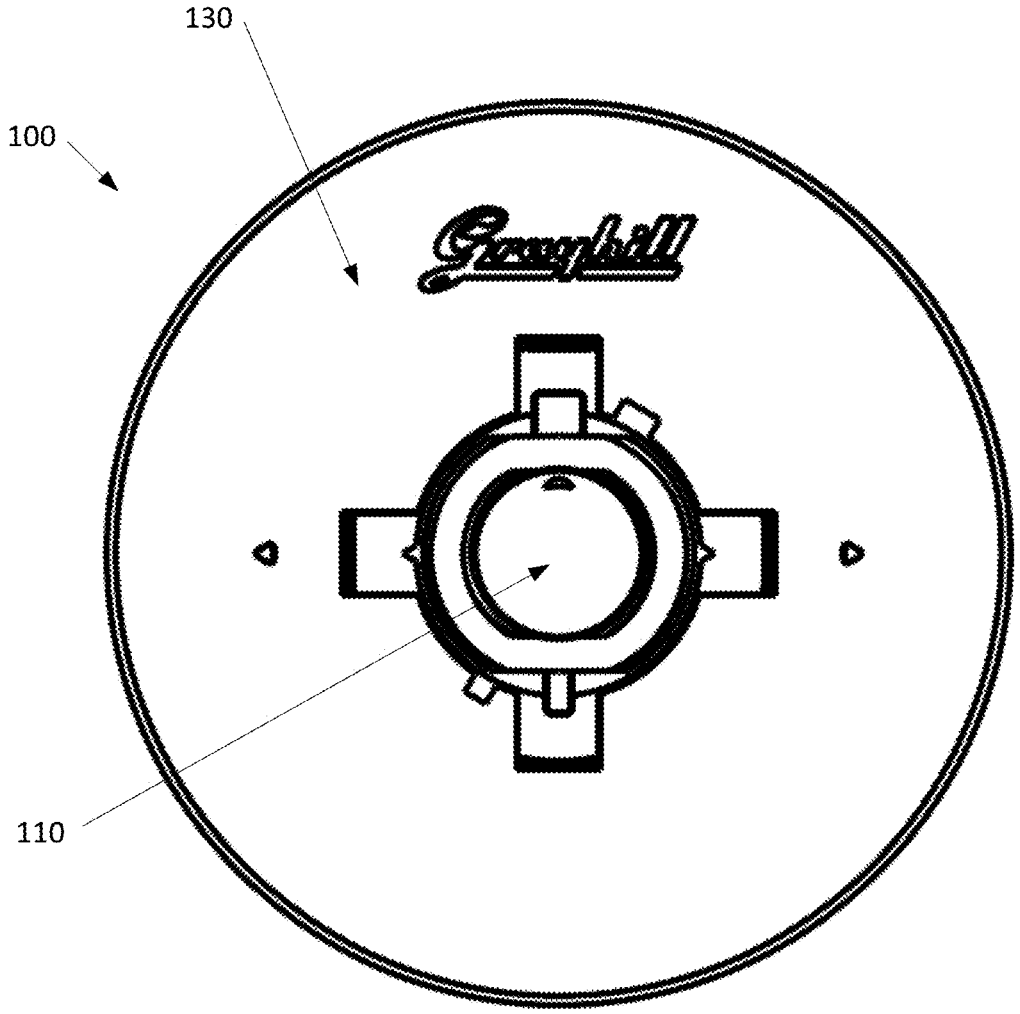
FIG. 2 illustrates a bottom-up view of the knob system in accordance with an embodiment of the present application.

FIG. 2 illustrates a bottom-up view, or view in the positive Z-direction, of the knob system 100. This view predominantly shows the back plate 130, which may be configured to mount against another surface for the purpose of affixing the knob system 100. Also shown is the bottom of the central aperture 111 of main housing 110, which is configured to extend through the center of back plate 130.

Figure 3C:
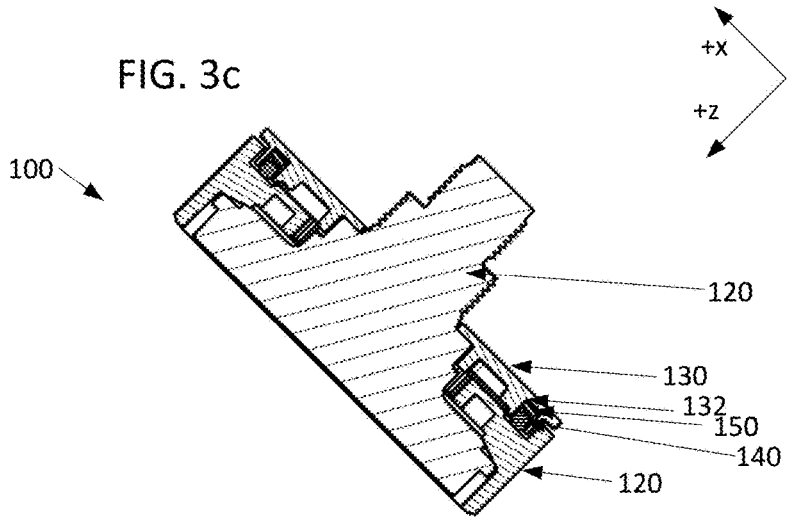
FIG. 3*c* illustrates a cutaway view of the knob system in accordance with an embodiment of the present application.
Figure 3A:
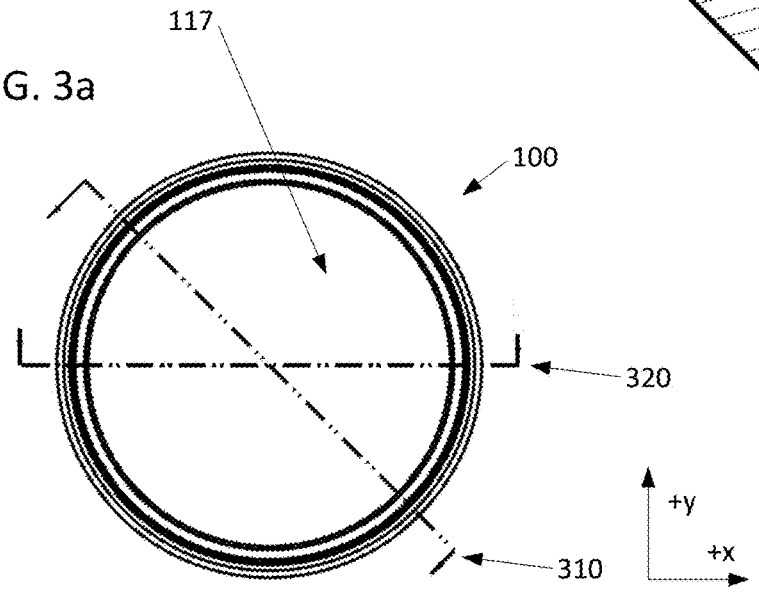
FIG. 3*a* illustrates a top-down view of the knob system in accordance with an embodiment of the present application.
Figure 3B:
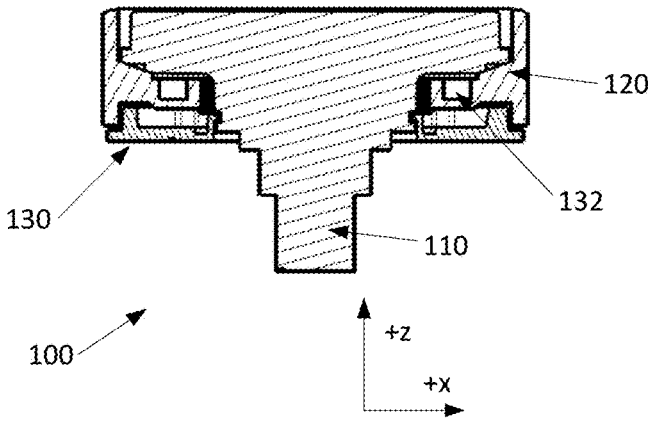
FIG. 3*b* illustrates a cutaway view of the knob system in accordance with an embodiment of the present application.

FIG. 3*a* illustrates a top-down view, or view in the negative Z-direction of the knob system 100. This view shows the central portion 117 configured to receive display 160. As no display 160 is included in FIG. 3*a*, the central portion 117 configured to receive display 160 is shown. Also included are two cutaway lines 310 and 320. Each cutaway line 310 and 320 corresponds to a different X-Z cross sectional view of the knob system 100. Here, cutaway line 310 corresponds to the X-Z cross sectional view of the knob system 100 of FIG. 3*b*, while cutaway line 320 corresponds to the X-Z cross sectional view of the knob system 100 of FIG. 3*c*. Both FIGS. 3*b* and 3*c* show main housing 110, knob 120, back plate 130, and back plate channel 132. Notably, FIG. 3*b* further illustrates Z-stop balls 140 and Z-support springs 150, while these features are not shown in FIG. 3*b*. Thus, as can be seen by contrasting FIG. 3*b* with FIG. 3*c*, an embodiment of the knob system 100 includes a back plate channel 132 extending circumferentially around the entire back plate 130, even where no Z-support springs 150 and corresponding Z-stop balls 140 are present.

Figure 4:
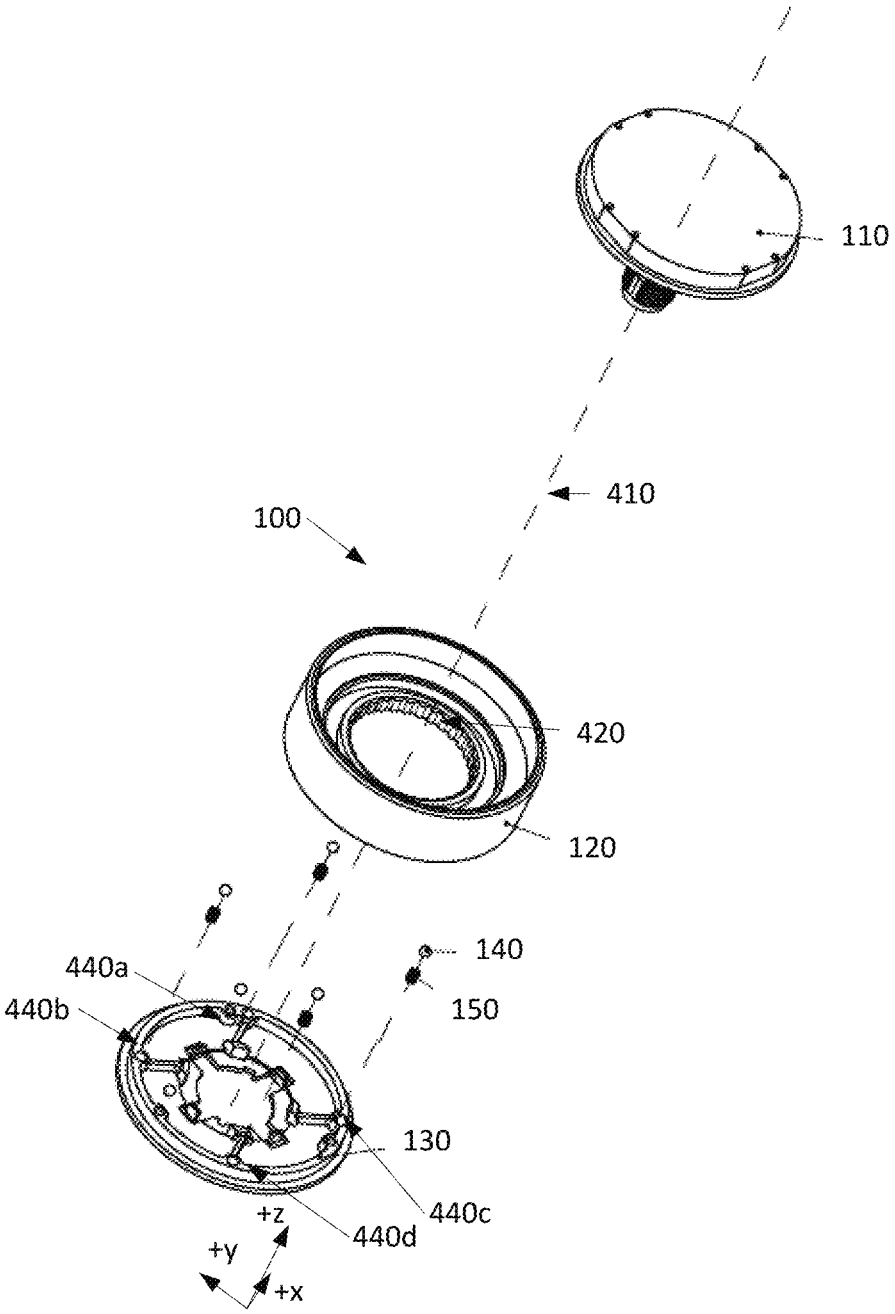
FIG. 4 illustrates a top isometric assembly view of the knob system in accordance with an embodiment of the present application.
Figure 5:
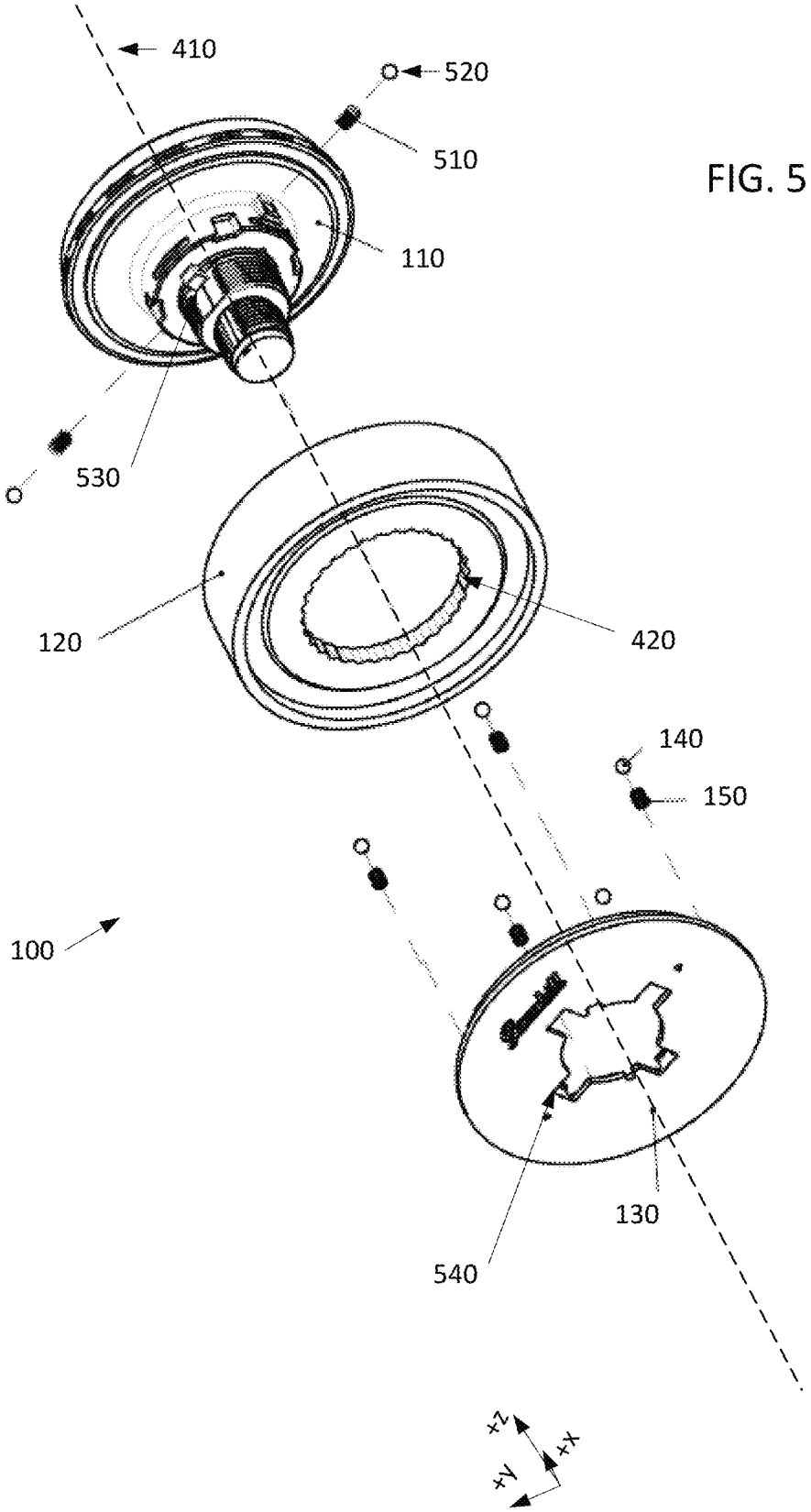
FIG. 5 illustrates a bottom isometric assembly view of the knob system in accordance with an embodiment of the present application.

FIGS. 4 and 5 illustrate two assembly views of the knob system 100, FIG. 4 being an assembly view illustrated from the isometric positive Z-direction (down from above) and FIG. 5 being illustrated from the negative Z-direction (up from below). Both FIGS. 4 and 5 illustrate a knob system 100, with a main housing 110, knob 120 and a back plate 130. Notably, both FIGS. 4 and 5 illustrate the knob system 100 dis-assembled along the centerline 410, which corresponds to knob system centerline 101 of FIG. 1. As shown in the embodiment illustrated in FIGS. 4 and 5, the back plate 130 is formed from a single piece of material. The back plate 130 may comprise separate wedges or circumferential rings that collectively make up back plate 130. In an embodiment, a spring retention plate 710 may be fitted between the main housing 110 and the back plate 130. Also as shown in FIGS. 4 and 5, the back plate channel 132 of FIG. 1 is substituted for a plurality of spring retention depressions 440*a* to 440*d*. A single spring retention depression 440*a* is configured to receive a single Z-support spring 150 and corresponding Z-stop ball 140. As shown in FIGS. 4 and 5, the back plate 130 comprises four spring retention depressions 440*a* to 440*d* with corresponding Z-support springs 150 and Z-stop balls 140 spaced equidistantly around a circumference of the back plate 130 at a constant radius from the centerline 410. However, it should be understood that any number of spring retention depressions 440*a* with corresponding Z-support springs 150 and Z-stop balls 140 may be provided. Further, the spacing of such features need not be equidistant or at a constant radius. For example, spring retention depressions 440*a* to 440*d* with corresponding Z-support springs 150 and Z-stop balls 140 may be spaced at two or more separate radii from the centerline 410, and need not be spaced equidistantly about a selected circumference of back plate 130.

As illustrated in FIGS. 4 and 5, the knob 120 comprises detent teeth 420. In such an embodiment, the main housing 110 will also comprise a detent spring 510 and a detent ball 520. The detent spring 510 and the detent ball 520 are configured to receive detent teeth 420, as shown in FIG. 5. The detent spring 510 and the detent ball 520 are configured to fit to detent teeth 420 for the purpose of communicating rotational position, speed and/or angular acceleration from the movable knob 120 a user by providing detent feedback to the user. In such an embodiment, the knob system 100 will provide detent feedback to the user when the user rotates the knob 120. Other feedback may be provided to the user in conjunction with the detent feedback, including images and/or video from the display 160, other tactile feedback, and/or audio feedback. As illustrated in FIG. 5, a knob system 100 may comprise two sets of detent springs 510 and detent balls 520. In an embodiment, a knob system 100 may comprise a single set of detent springs 510 and detent balls 520. In an embodiment, 10 or more sets of detent springs 510 and detent balls 520 may be used.

FIG. 5 also illustrates mounting notch 530 and mounting recess 540. As illustrated, the knob system 100 comprises four mounting recesses 540. In the illustrated embodiment, a knob system 100 is positioned such that a mounting notch 530 is fitted into a mounting recess 540. When the mounting notch 530 is fitted against the mounting recess 540, the mounting notch 530 locks or snaps into the mounting recess 540. Such a configuration of the mounting notch 530 fitting against the mounting recess 540 retains the knob 120 between the main housing 110 and the back plate 130 in the Z-direction. A mounting notch 530 may also be unsnapped or unlocked from a mounting recess 540, such that a user may disassemble the knob system 100 and remove the main housing 110 and knob 120 from the back plate 130.

Figure 6:
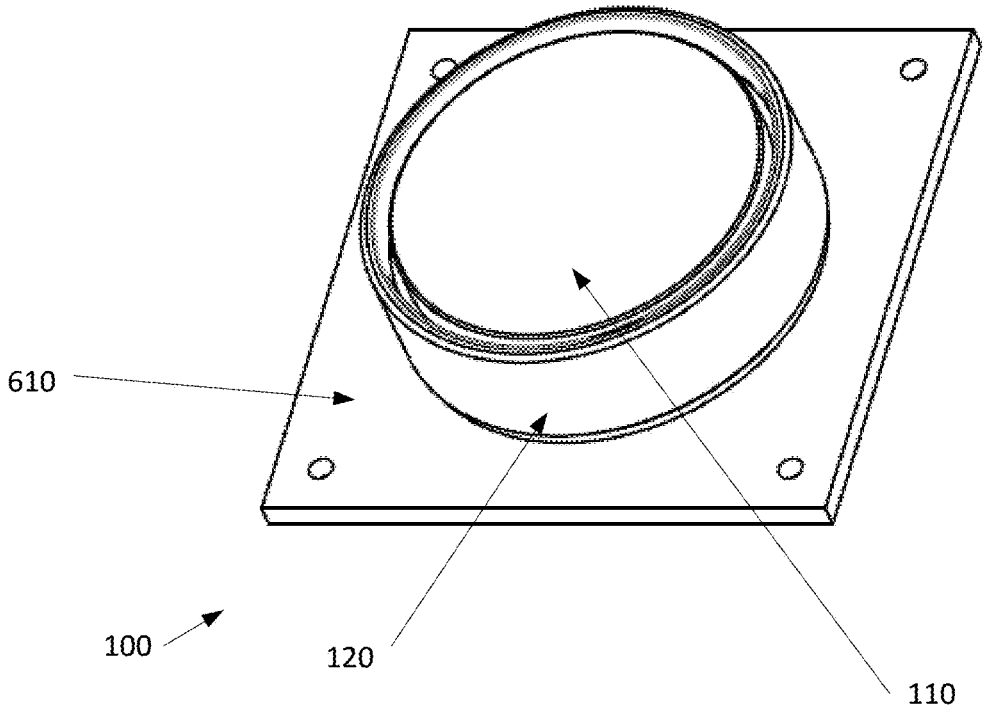
FIG. 6 illustrates a view of the knob system mounted on a knob system mount in accordance with an embodiment of the present application.

FIG. 6 illustrates a view of the knob system 100 mounted on a knob system mount 610 in accordance with an embodiment of the present application. FIG. 6 illustrates a knob system 100 shown with a main housing 110 and knob 120. The surface of the back plate 130 may be configured to be affixed to a knob system mount 610 or other location desired by the user. A knob system mount 610 may comprise an application for use with the knob 120. Non-limiting examples of applications for use with the knob system 100 comprise medical devices, manufacturing devices or machinery, power machinery, automobiles, computer applications, telecommunication or connectivity devices, aerospace applications, and combinations thereof.

Figure 7:
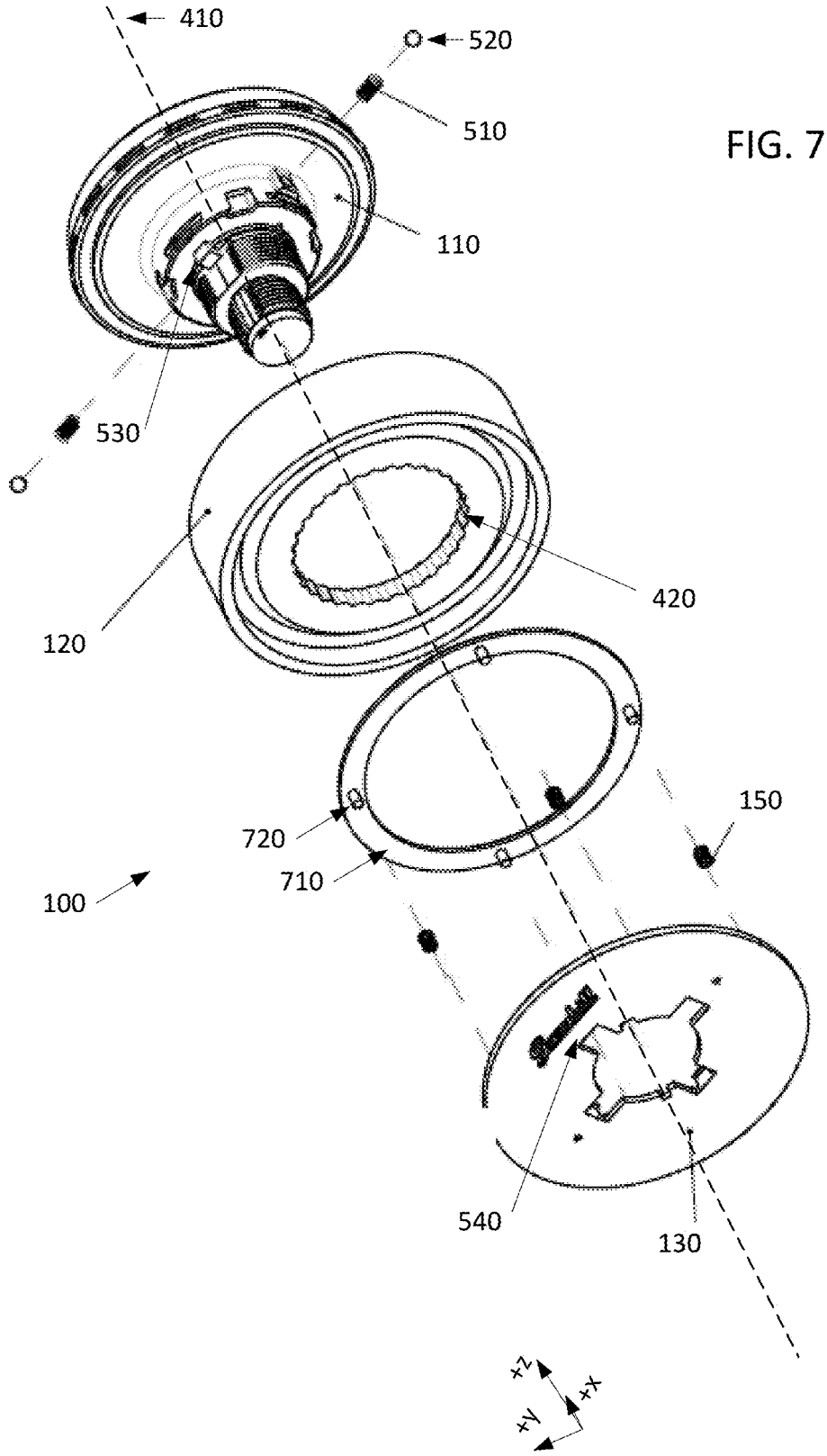
FIG. 7 illustrates a bottom isometric assembly view of the knob system in accordance with an embodiment of the present application.

FIG. 7 illustrates a bottom isometric assembly view of the knob system 100 in accordance with an embodiment of the present application. FIG. 7 is an assembly view illustrated from the isometric negative Z-direction (up from below). FIG. 7, like FIGS. 4 and 5, illustrates a knob system 100, with a main housing 110, knob 120 and a back plate 130. As shown in FIGS. 4 and 5, the back plate 130 comprises a single piece.

FIG. 7 also illustrates spring retention plate 710. Spring retention plate 710 is fitted between the main housing 110 and/or knob 120 and the back plate 130. The spring retention plate 710 further comprises spring retainers 720. Spring retainers 720 are placed on spring retention plate 710 in a manner corresponding to a desired layout of Z-support springs 150. Spring retainers 720 are used to retain a desired spacing of Z-support springs 150.

FIG. 7 is shown without Z-stop balls 140. In such an embodiment, the Z-support springs 150 fit around or are otherwise fixed upon spring retainers 720, thereby biasing the spring retention plate 710 in the positive Z-direction away from the back plate 130. The spring retention plate 710 contacts the knob 120 as the spring retention plate 710 is biased in the positive Z-direction. The spring retention plate 710 fits rotatably against the knob 120 so that the knob 120 may rotate in the X-Y plane. As such, the spring retention plate 710 serves the function of the Z-stop balls 140. A configuration comprising a spring retention plate 710 may be advantageous over a configuration using Z-stop balls 140 to aid in manufacturing, as there is only a single spring retention plate 710 to install instead of a plurality of Z-stop balls 140 and the larger spring retention plate 710 may be easier to manipulate by an assembly technician.

While FIG. 7 shows four Z-support springs 150 and four corresponding spring retainers 720, fewer or additional Z-support springs 150 and corresponding spring retainers 720 may be used. The Z-support springs 150 and corresponding spring retainers 720 may additionally be unevenly spaced about the spring retention plate 710. Further, the spring retention plate 710 and the knob 120 may be made from a material having a formulation that aids the spring retention plate 710 in sliding against the knob 120. In an embodiment, a contact area between the spring retention plate 710 and the knob 120 may be coated or lubricated to aid the spring retention plate 710 in sliding against the knob 120. Such a material, coating, or lubricant may increase the useable life of the knob 120 and/or decrease the force required by a user to rotate the knob 120.

It should be understood that various changes and modifications to the examples described here will be apparent to those skilled in the art. Such changes and modifications can be made without departing from the spirit and scope of the present subject matter and without diminishing its intended advantages. It is therefore intended that such changes and modifications be covered by the appended claims. Further, the present disclosure is thus not to be limited to the precise details of methodology or construction set forth above as such variations and modification are intended to be included within the scope of the present disclosure. Moreover, unless specifically stated any use of the terms first, second, etc. do not denote any order or importance, but rather the terms first, second, etc. are merely used to distinguish one element from another.

What is claimed is:

1. A knob system comprising:

a back plate assembly, the back plate assembly comprising a back plate, a plurality of bearings, a plurality of stop balls, and a plurality of support springs;

a knob assembly, the knob assembly comprising an outer perimeter wall extending circularly around a central aperture, the central aperture comprising a plurality of ridges spaced around a central aperture surface and located within a knob plate extending from the circular aperture to an inner surface of the outer perimeter wall, wherein the knob plate comprises a horizontal portion and an inclined portion, the inclined portion being inclined at an upward angle in relation to the horizontal portion from the center of the knob plate; and a main housing extending through the knob plate and the back plate, wherein at least one of the plurality of bearings is in contact with the back plate and configured to separate the knob from the back plate when the main housing is depressed in a vertical direction, a first stop ball of the plurality of stop balls is attached to a first support spring of the plurality of support springs, and the first support spring biases the first one stop ball against the knob assembly, and wherein the first support spring biases the first stop ball against a lower surface of the inclined portion of the knob to provide a consistent and constant force into the lower surface of the inclined portion of the knob plate.

2. The knob system according to claim 1, wherein the main housing extends axially through the knob assembly and is concentrically located within the knob assembly.

3. The knob system according to claim 1, wherein the knob assembly is configured to depress around the main housing when the outer perimeter wall is grasped by a user and a depression force is applied.

4. The knob system according to claim 1, wherein the inclined portion is inclined at an angle of 20 degrees in relation to the horizontal portion.

5. The knob system according to claim 1, wherein the plurality of ridges are spaced equidistantly around the aperture surface.

6. The knob system according to claim 1, which includes grease disposed around the plurality of ridges spaced around the aperture surface, which act as a grease reservoir to slowly release grease to provide lubrication between the knob and the housing.

7. The knob system according to claim 1, wherein an upper surface of the back plate comprises a support channel circumnavigating the central aperture of the back plate.

8. An apparatus for biasing movement of a knob, comprising:

a knob comprising an outer perimeter wall extending circularly around a central aperture;

a back plate; and a main housing, the main housing extending through the knob and the back plate; and wherein the back plate comprises a plurality of bearings, a plurality of stop balls, and a plurality of support springs, the bearings being in contact with the back plate and configured to separate the knob from the back plate when the main housing is depressed in a vertical direction, a first stop ball of the plurality of stop balls being attached to a first support spring of the plurality of support springs; and the first support spring biases the first stop ball against the knob, and wherein the first support spring biases the first stop ball against a lower surface of an inclined portion of the knob to provide a consistent and constant force into the lower surface of the inclined portion of the knob.

9. The apparatus according to claim 8, wherein the main housing extends axially through the knob and is concentrically located within the knob.

10. The apparatus according to claim 8, wherein the central aperture comprises a plurality of ridges spaced equidistantly around the aperture surface.

11. The apparatus according to claim 8, wherein the circular aperture is located within a knob plate extending from the circular aperture to an inner surface of the outer perimeter wall.

12. The apparatus according to claim 11, wherein the knob plate includes a horizontal portion and the inclined portion; wherein the inclined portion is inclined at an upward angle in relation to the horizontal portion.

13. The apparatus according to claim 8, wherein the knob is configured to rotate around the main housing when the outer perimeter wall is grasped by a user and a rotational force is applied.

14. The knob system according to claim 8, wherein an upper surface of the back plate comprises a support channel circumnavigating the central aperture of the back plate; and wherein the plurality of stop balls are contained in the support channel.

15. A method for limiting unintended horizontal or vertical displacement of a knob, comprising:

configuring a main housing to extend through a knob and a back plate, the knob comprising an outer perimeter wall extending circularly around a central aperture;

disposing a plurality of bearings, a plurality of stop balls, and a plurality of support springs around the back plate;

configuring a first support spring of the plurality of support springs to bias a first stop ball of the plurality of stop balls against a lower surface of an inclined portion of the knob to provide a consistent and constant force into the lower surface of the inclined portion of the knob;

wherein the bearings are in contact with the back plate and configured to separate the knob from the back plate when the main housing is depressed in a vertical direction.

16. The method according to claim 15, further comprising configuring the central aperture to comprise a plurality of ridges spaced equidistantly around the aperture surface.

17. The method according to claim 15, further comprising locating the circular aperture within a knob plate extending from the circular aperture to an inner surface of the outer perimeter wall.

18. The method according to claim 15, further comprising configuring the knob plate to include a horizontal portion and the inclined portion; wherein the inclined portion is inclined at an upward angle in relation to the horizontal portion.

19. The method according to claim 15, further comprising configuring an upper surface of the back plate to comprise a support channel circumnavigating the central aperture of the back plate and containing the plurality of stop balls in the support channel.

20. The method according to claim 16, further comprising configuring a grease reservoir around the aperture to slowly release grease to provide lubrication between the knob and the housing.

* * * * *